United States Patent [19]

Sayler et al.

[11] Patent Number: 4,478,150

[45] Date of Patent: Oct. 23, 1984

[54] CARTRIDGE WITH ELASTIC PUSHER CUP

[75] Inventors: William M. Sayler, Bradshaw; John M. Hayner, Towson, both of Md.

[73] Assignee: The United States of America as represented by the Secretary of the Army, Washington, D.C.

[21] Appl. No.: 457,334

[22] Filed: Jan. 12, 1983

[51] Int. Cl.[3] ..... F42B 5/02

[52] U.S. Cl. ..... 102/430; 102/464

[58] Field of Search ..... 102/439, 443, 444, 447, 102/464, 430

[56] References Cited

U.S. PATENT DOCUMENTS

| | | | |
|---|---|---|---|
| 3,119,302 | 1/1964 | Barr | 89/1 B |
| 3,738,271 | 6/1973 | La Costa | 102/430 |
| 3,967,552 | 7/1976 | Settles et al. | 102/430 |

*Primary Examiner*—Harold J. Tudor

*Assistant Examiner*—Tyrone Davis

*Attorney, Agent, or Firm*—Anthony T. Lane; Robert P. Gibson; Harold H. Card, Jr.

[57] ABSTRACT

A gas actuated cartridge, which is smokeless, flashless and noiseless in operation, contains a novel pusher cup of elastic material, such as butyl rubber. The pusher cup is folded back within itself and contains an exterior annular flange which fits into a groove in the bore of the cartridge case. A closure plug containing the propellant charge is threadably attached to the bore of the cartridge case and engages the interior of the cup in the flange portion to seal and anchor the cup in the bore. The elastic cup can propel a projectile by the unfolding action of the cup, and expands without rupture to contain the propellant gases and contracts when the volume of the gases reduces on cooling, whereby the cup shrinks back from the wall of the gun barrel and, hence, can be readily removed from the barrel.

1 Claim, 4 Drawing Figures

CARTRIDGE WITH ELASTIC PUSHER CUP

GOVERNMENTAL INTEREST

The invention described herein may be manufactured, used and licensed by the Government for governmental purposes without the payment to us of any royalty thereon.

BACKGROUND OF THE INVENTION—PRIOR ART

The present invention relates to an improvement in cup sealed cartridges, wherein a telescoped pusher cup, which is folded back within itself, is employed for the dual functions of sealing propellant gases and propelling an item, such as a piston or a projectile, by the unfolding action of the pusher cup.

Cartridges of the aforesaid type are described in U.S. Pat. Nos. 3,106,131 and 3,404,598. The pusher cup employed in the cartridges of these patents is fabricated of material, such as aluminum, which is capable of permanent plastic deformation, i.e., is substantially self-sustaining in the deformed position and will not self-restore itself to the shape or size it originally held prior to deformation, such as would be effected in elastic deformation. The drawn aluminum cup employed was folded back within itself so that when the cartridge was fired the cup unfolded and pushed the piston or projectile forward. In operation, however, the aluminum pusher cup expanded and remained in the expanded state in the gun barrel, causing it to seize in the barrel and thus rendering its removal very difficult. In an attempt to overcome this problem, the aluminum cup was coined so that the coined disk would blow out when the cartridge was fired and thereby allow the aluminum cup to shrink back from the wall of the gun barrel. This made it possible to remove the cartridge from the gun barrel but prevented the cartridge from smokeless, flashless and noiseless operation. Also, noise radiated through the wall of the aluminum cup.

SUMMARY OF THE INVENTION

A principal object and advantage of the present invention is to provide a cup-sealed cartridge containing a novel pusher cup made of an elastic material, such as butyl rubber, which is flashless, smokeless and substantially noiseless in operation, and overcomes the disadvantages of the cup-sealed explosive cartridges of the prior art. Other objects and advantages will become obvious from the following description of the invention.

DESCRIPTION OF THE PREFERRED EMBODIMENT

Figure 1:
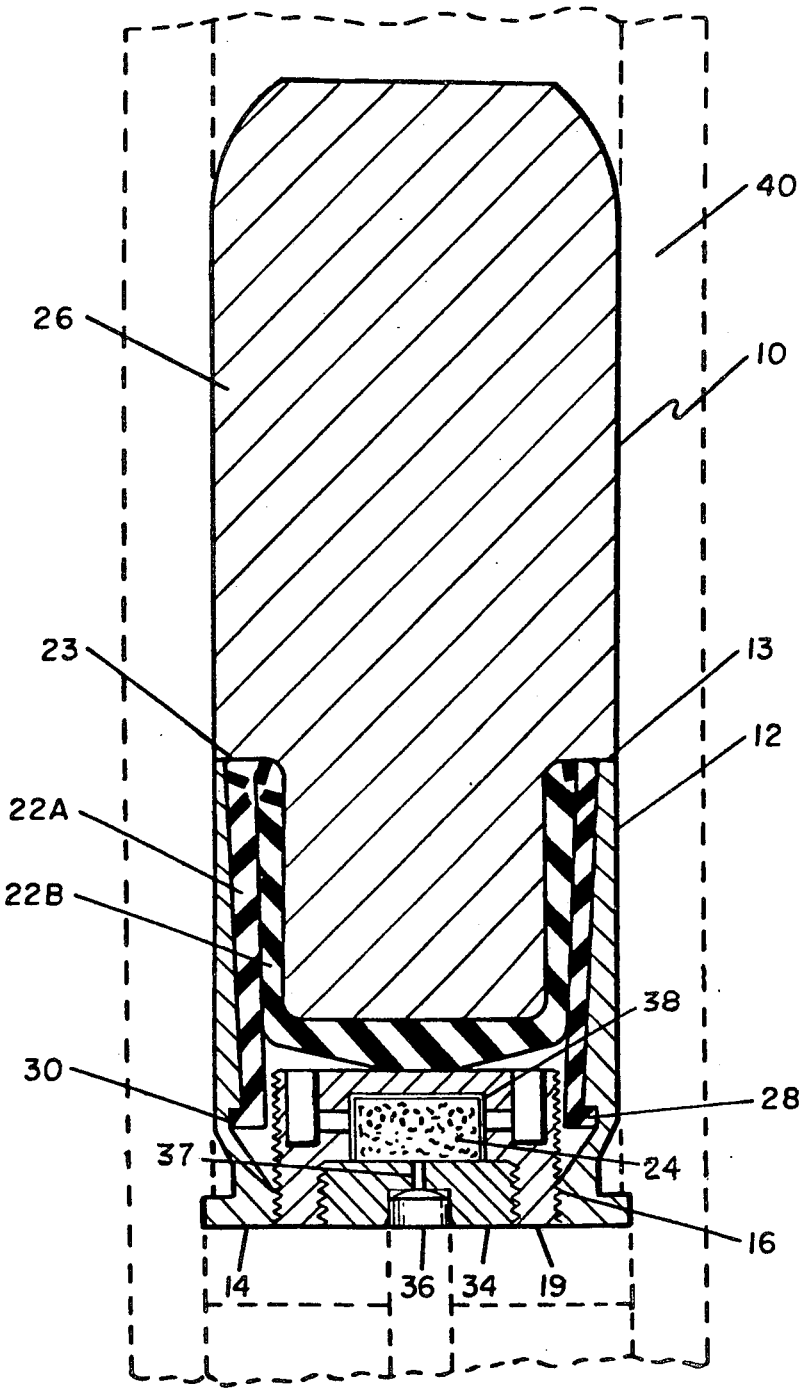
FIG. 1 is a longitudinal section view of a gas-sealed cartridge containing an elastic pusher cup of the present invention prior to ignition of the propellant charge.
Figure 2:
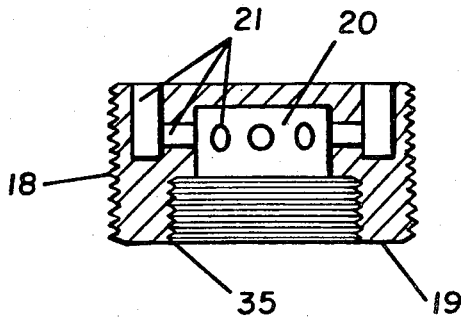
FIG. 2 is a longitudinal section view of the adapter for containing the propellant charge and locking the pusher cup in the cartridge case.
Figure 3:
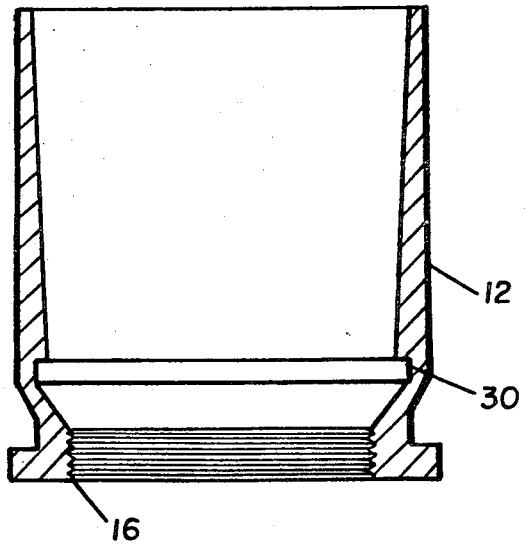
FIG. 3 is a longitudinal section view of a cartridge case containing locking means for a pusher cup shown in FIGS. 1 and 4.

With reference to the drawings, FIG. 1 shows a 40 mm cartridge 10 including a tubular case 12 having an open forward end 13 and closable rearward end 14. The rearward end 14 of the cartridge case contains internal threads 16, which engage the external threads 18 of the adapter plug 19 for closing the rear end of the cartridge case. As shown in FIGS. 1 and 2, the adapter 19 contains a gas generation chamber 20, which contains a propellant charge 24 in a frangible propellant cup 38. The chamber 20 is closed by disc 34 containing primer 36 and is provided with gas ports 21 directed at the bottom of the tubular pusher cup 22, as shown in FIG. 1. The pusher cup is disposed within the case 12 and functions to seal the propellant gases generated from the propellant charge 24 and convey the propelling force of the gases to the projectile 26 by the unfolding action of the cup seal similar to that described in the aforementioned patents.

Figure 4:
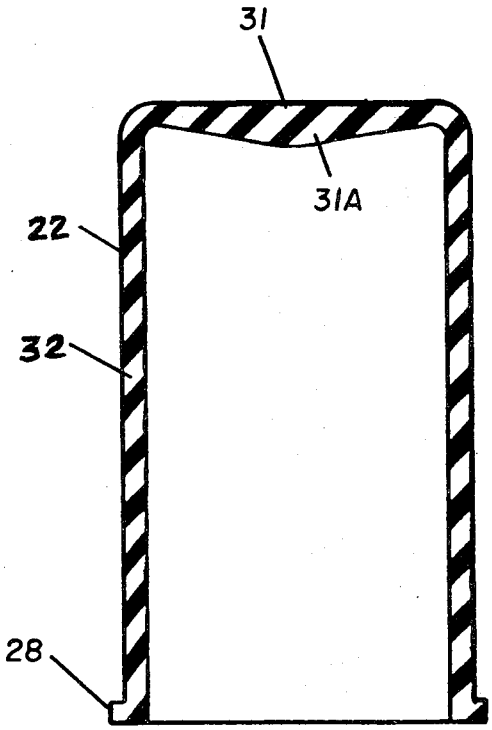
FIG. 4 is a longitudinal section view of a preferred embodiment of a pusher cup of the present invention.

The pusher cup 22 is made of an elastic material, such as butyl rubber, which allows it to stretch and return substantially to its original size or shape. As shown in FIG. 4, the pusher cup 22 is essentially of cylindrical shape which fits into the case 12. The cup has a sidewall 32 and bottom or closed end 31, and is provided at its open end with an exterior annular flange 28 which fits into an annular groove 30 in the inner surface of the case sidewall. Also, to prevent rupture of the cup by the propellant gases, the wall thickness at the closed end or bottom 31 of the pusher cup is increased toward the central region 31A.

To assemble the cartridge, the rubber pusher cup 22 is inserted into the cartridge case 12 until the flange 28 thereof snaps into the annular groove 30 in the case 12. The adapter plug 19 is then screwed into the threaded end 14 of the cartridge case so that it engages the interior surface of the cup wall in a region above the flange 28, thereby locking the flange 28 in the groove 30 and thus sealing and anchoring the pusher cup into place. The projectile 26 is then inserted. The forward portion of the cylindrical projectile possesses a diameter corresponding to the bore of the gun barrel 40 illustrated by phantom lines shown in FIG. 1, while the rearward portion is of reduced diameter which fits in complementray relationship into the well formed when the cup is folded back on itself. The projectile is inserted by pushing the rear thereof against the closed end 31 of the pusher 22 so as to telescope the cup to form an outer tubular section 22A and an inner tubular section 22B connected by an annular bend 23 in the tubular sidewall 32, as shown in FIG. 1. To facilitate folding of the cup within itself, the bore of the tubular case 12 has a greater diameter at its forward end 13 than at its rearward end 14. Thereafter, the frangible propellant cup 38 containing the propellant charge 24 is loaded into the chamber 20, which is closed by screwing the externally threaded closure disc 34 containing primer 36 and channel 37 into engagement with the interior threads 35 of the adapter 19, as shown in FIG. 1.

In operation, the cartridge 10 is placed in the breech of a gun barrel 40 and the propellant charge 24 is initiated by ignition of the primer 36 in known manner. The resulting gases blow out the frangible propellant cup 38 through the gas ports 21 and impinge on the closed end 31 of the pusher cup, whereby the expanding gases cause the pusher cup to unfold and propel the projectile forward.

By employing a pusher cup made of an elastic material including natural or synthetic elastomers such as butyl rubber, the cartridge can be fired without flash, smoke or noise, and can be easily removed from the gun barrel. The rubber cup contains the generated gases and expands, filling the gun barrel as the projectile is propelled forward. The rubber cup does not rupture and thus contains the flash and smoke from the exploded propellant charge. When the propellant gases cool and reduce in volume, the rubber cup does not remain wedged against the wall of the gun barrel but contracts rapidly, thus allowing it to be readily removed from the gun barrel. Further, the noise of the explosion is deadened by the acoustic insulation of the rubber cup, which by filling the gun barrel also eliminates vacuum noise.

Test firings showed that 40 mm cartridge rounds containing the novel rubber pusher cup equaled or exceeded similar rounds containing an aluminum pusher cup in terms of projectile velocity and distance with no muzzle flash or smoke and practically no noise.

We have found that the thickness of the cup bottom 31 (see FIG. 4), particularly toward the center region thereof, must be increased to achieve optimum results without rupture of the cup. In a preferred embodiment of a butyl rubber cup for a 40 mm round illustrated in FIG. 1, the bottom wall of the cup had a thickness of 0.124 in. at its juncture with the cup widewall of 0.063 in. thickness, and possessed a taper of about 7 degrees toward the center thereof. Pusher rubber cups having a uniform sidewall and bottom wall thickness of 0.063 in. ruptured at 20 psi static pressure, whereas those of the preferred embodiment withstood 60 psi static pressure. Test firings of 40 mm rounds containing a butyl rubber cup of the preferred design successfully fired a 200 gm. projectile 260 meters at 210 ft/sec. with 0.450 gm. of M9 propellant without rupturing, whereas corresponding cups having a uniform side and bottom wall thickness of 0.063 in. ruptured with 0.250 gm. of M9 propellant.

The use of a rubber pusher cup in accordance with the present invention is particularly advantageous for propelling a non-rigid material, such as powdered aluminum, pyrotechnic mixes, etc., wherein it is undesirable for the hot explosive/propelling gases to come into contact with the material. Since the rubber cup is elastic, it does not require a rigid payload (which acts as a die mandrel to control the flow of a non-elastic cup material, such as aluminum) for the cup to unfold uniformly and propel the payload.

We claim:

1. In an improved 40 mm ammunition cartridge comprising:

a case including a bore, said bore having an interior surface provided with a groove, a tubular cup seal disposed in said bore, said cup seal having an outer tubular section and an inner tubular section connected by a single annular fold section circumscribing an area, said inner tubular section having a sidewall and a closed end, said outer tubular section having an open end including an exterior annular flange disposed in said annular groove, said closed end increasing in thickness towards the center at an angle of about 7° from the juncture with said sidewall, means for locking said flange in said groove to anchor and seal said cup in said bore;

a 40 mm projectile inserted in said circumscribed area of said annular fold, and propellant gas generating composition disposed adjacent said open end of said cup seal, said cup seal being made of elastic material capable of expanding without rupture to contain the generated gas, and of contracting on reduction in volume of said gases on cooling for removal from a gun after firing said propellant composition.

* * * * *